United States Patent [19]

Paul et al.

[11] Patent Number: 4,932,223

[45] Date of Patent: Jun. 12, 1990

[54] AUGER CONSTRUCTION FOR ICE-MAKING APPARATUS

[75] Inventors: Roger W. Paul; David A. Tandeski, both of Albert Lea, Minn.

[73] Assignee: Scotsman Industries, Vernon Hills, Ill.

[21] Appl. No.: 334,603

[22] Filed: Apr. 7, 1989

[51] Int. Cl.[5] ..... F25C 5/12

[52] U.S. Cl. ..... 62/354; 366/90; 366/324

[58] Field of Search ..... 62/354; 366/90, 324; 100/117, 145

[56] References Cited

U.S. PATENT DOCUMENTS

| | | | |
|---|---|---|---|
| 2,680,879 | 6/1954 | Schnuck et al. | 366/90 |
| 3,690,623 | 9/1972 | Boyne | 366/90 X |
| 3,869,875 | 3/1975 | Verlinden et al. | 62/354 |
| 3,941,535 | 3/1976 | Street | 366/90 X |
| 4,103,355 | 7/1978 | Weber | 366/90 |
| 4,199,263 | 4/1980 | Menges et al. | 366/90 |
| 4,304,054 | 12/1981 | Nauck | 366/90 X |
| 4,525,073 | 6/1985 | Spinner | 366/90 X |
| 4,600,311 | 7/1986 | Mourrier et al. | 366/90 X |
| 4,682,475 | 7/1987 | Nelson | 366/310 X |
| 4,779,989 | 10/1988 | Barr | 366/90 |

*Primary Examiner*—William E. Tapoicai

*Attorney, Agent, or Firm*—Harness, Dickey & Pierce

[57] ABSTRACT

An auger-type ice-making apparatus includes a new and improved auger or auger assembly having one or more generally spiral flight portions with one or more grooves formed transversely across the outer edges of the flight portions. The grooves interrupt the generally spirally-extending contact between the outer auger edges and the inner surface of an evaporator housing, thus reducing the area of contact therebetween and, as a result, reducing the load on the auger bearings. The grooves also provide a stress-relieved area on the flight portion during scraping of ice particles from the inner surface of the evaporator and tend to balance the forces on the auger bearings.

8 Claims, 2 Drawing Sheets

Fig. 1.
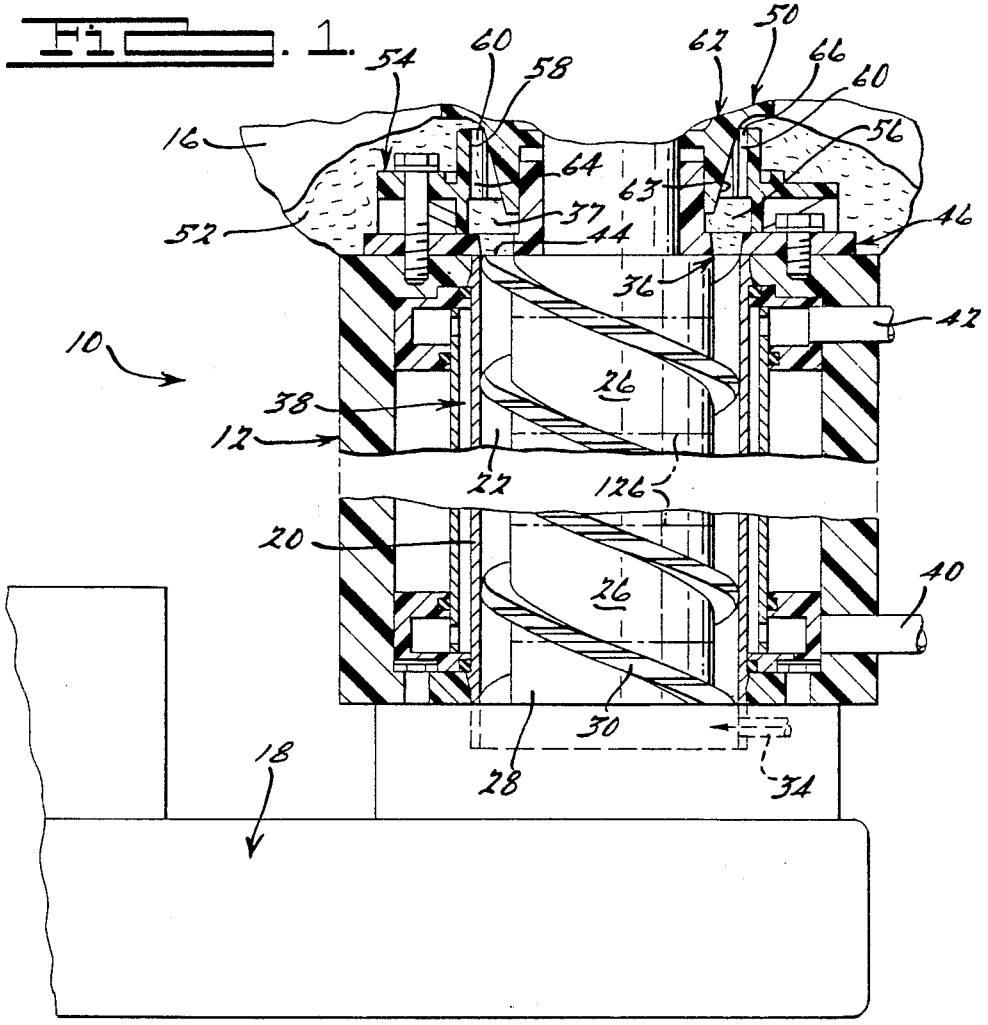
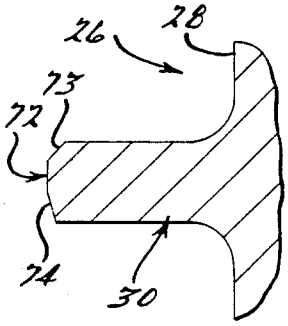
Fig. 5.
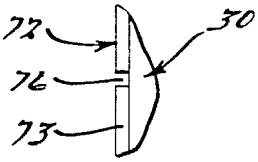
Fig. 6.

AUGER CONSTRUCTION FOR ICE-MAKING APPARATUS

BACKGROUND AND SUMMARY OF THE INVENTION

Generally, the present invention is directed toward a new and improved ice-making apparatus of the type including a combination evaporator and ice-forming assembly and having a substantially cylindrical freezing chamber with an auger rotatably mounted therein for scraping ice particles from the inner surface of the freezing chamber in order to form quantities of relatively wet and loosely associated ice particles. More specifically, the present invention is directed toward an improved auger construction for such an ice-making apparatus.

Various ice-making machines and apparatus have been provided for producing so-called flake or chip ice and have frequently included vertically-extending rotatable augers that scrape ice crystals or particles from tubular freezing cylinders disposed about the periphery of the augers. The augers in some of such prior devices typically urge the scraped ice in the form of a relatively wet and loosely associated slush through open ends of their feezing cylinders, and perhaps through a die or other device in order to form the flake or chip ice product. Still other prior ice-making machines or apparatuses have included devices for forming the discharged slush into relatively hard ice in order to form discrete ice pieces of various sizes, including relatively large ice pieces commonly referred to as "cubes" and relatively small ice pieces commonly referred to as "nuggets".

Furthermore, in the ice-making machines or apparatuses of the above-described type having a rotatable auger, the augers have typically been very complex and expensive, and very high radial forces have been exerted on the auger bearings, thus requiring a relatively powerful drive means that is expensive to purchase, maintain, and operate. Accordingly, in response to the need for an auger design that is capable of reducing the bearing loads during scraping and that is less expensive and complex to produce and less expensive to operate, alternate auger constructions have been devised with a view toward reducing auger energy usage, and thus increasing the overall efficiency of the ice-making apparatus, and toward reducing the cost and complexity of auger construction.

Some examples of the above-mentioned improved auger constructions are described and claimed in the previous related patent, U.S. Pat. No. 4,682,475, issued July 28, 1987, and owned by the same assignee as that of the present invention. The disclosure of such previous patent, U.S. Pat. No. 4,682,475, is hereby incorporated herein by reference.

An ice-making machine or apparatus according to the present invention, whether or not including the above-discussed interchangeable head assemblies or other components, also preferably includes an auger member or assembly having one or more generally spiral flight portions with discontinuous or interrupted ice-scraping edges that serve to break up the relatively wet and loosely associated slush ice quantities produced in the combination evaporator and ice-forming assembly into smaller pieces and that tends to reduce and balance the loads on the auger bearings. In various forms of the invention, the auger member or assembly can be of a solid, one-piece construction, or can optionally be composed of a series of discrete disc elements or segments axially stacked on a rotatable shaft and secured for rotation therewith. In such an alternate construction, the discrete disc elements can be individually molded from inexpensive and lightweight synthetic plastic materials. In another alternate form of the invention, the auger member or assembly can include a rotatable core onto which the auger body is integrally molded from a synthetic plastic material. In this alternate embodiment of the invention, the spiral flight portion can be molded along with the remainder of the body of the auger or can be a discrete structure integrally molded therein.

It is accordingly a general object of the present invention to provide a new and improved ice-making machine, apparatus or system.

Still another object of the present invention is to provide a new and improved ice-making machine, apparatus or system having reduced energy requirements by way of a new construction of the auger assembly.

Additional objects, advantages and features of the present invention will bcome apparent from the following description and the appended claims, taken in conjunction with the accompanying drawings.

BRIEF DESCRIPTION OF THE DRAWINGS

FIG. 1 is a partial cross-sectional view of one example of a combination evaporator and ice-making assembly of an ice-forming apparatus according to the present invention.

FIG. 5 is a cross-sectional view taken generally through line 5—5 of FIG. 2.

FIG. 6 is a partial, detail view of a portion of an ice-scraping flight of the auger member of FIG. 2, looking generally in the direction of the arrow 6 in FIG. 2.

DETAILED DESCRIPTION OF THE PREFERRED EMBODIMENTS

Figure 2:
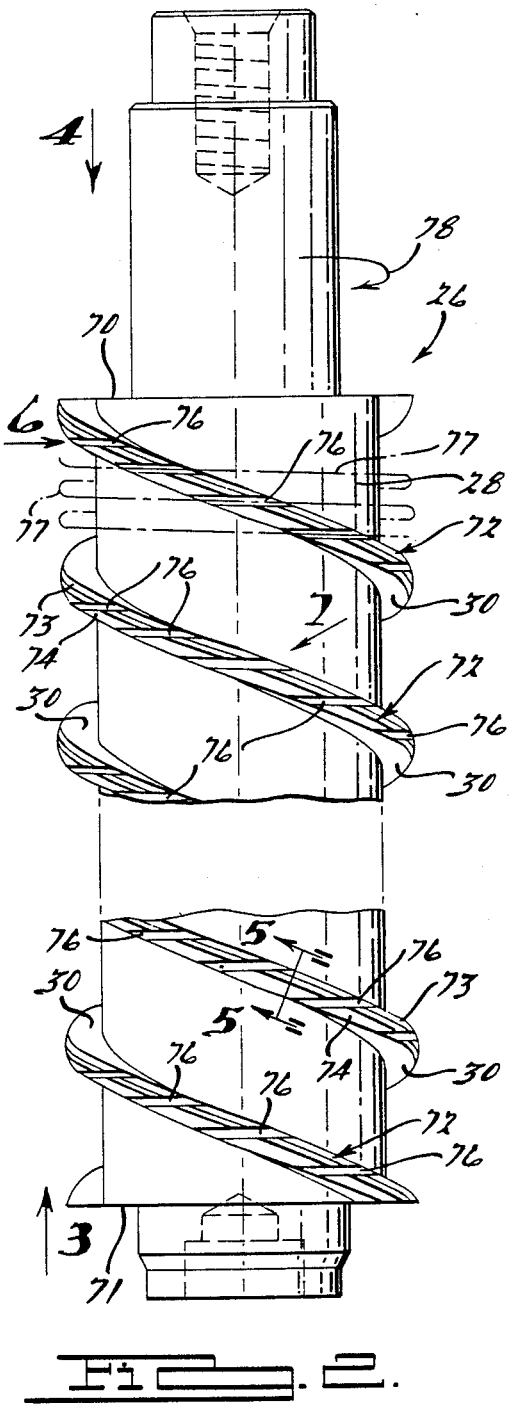
FIG. 2 is a longitudinal view of an exemplary embodiment of an improved auger member, according to the present invention, adapted for use in an ice-making apparatus such as that shown in FIG. 1.
Figure 4:
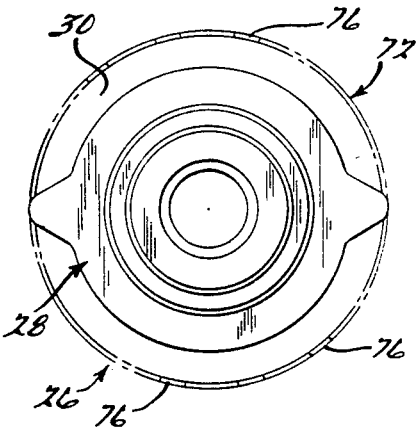
FIGS. 3 and 4 are respective end views of the exemplary auger member of FIG. 2, looking generally in the direction of arrows 3 and 4, respectively.

FIGS. 1 through 7 depict an exemplary preferred embodiment of the present invention for purposes of illustration. One skilled in the art will readily recognize that the principles of the present invention are equally applicable to other types of ice-making apparatuses.

As shown in FIG. 1, an ice-making machine or apparatus 10, in accordance with one preferred embodiment of the present invention, generally includes a combination evaporator and ice-forming assembly 12 operatively disposed between an ice product rceiving area 16 and a suitable drive means assembly 18. As is conventional in the art, the ice-making apparatus 10 is provided with a suitable refrigeration compressor and condenser (not shown), which cooperate with the combination evaporator and ice-forming assembly 12, all of which are connected through conventional refrigeration supply and return lines (not shown) and function in the usual manner such that a flowable gaseous refrigerant material at a relatively high pressure is supplied by the compressor to the condenser. The gaseous refrigerant is cooled and liquified as it passes through the condenser and flows to the evaporator and ice-forming assembly 12 wherein the refrigerant is evaporated or vaporized by the transfer of heat from water which is being formed into ice. The evaporated gaseous refrigerant then flows from the evaporator and ice-forming assembly 12 back to the inlet or suction side of the compressor for recycling through the refrigation system.

Generally speaking, the combination evaporator and ice-forming assembly 12 includes an inner housing 20 defining a substantially cylindrical freezing chamber 22 for receiving ice make-up water therein. An axially-extending auger or auger assembly 26 is rotatably disposed within the freezing chamber 22 and generally includes a central body portion 28 with one or more generally spirally-extending flight portions 30 thereon disposed in the space between the central body portion 28 and the inner surface of the inner housing 20 in order to rotatably scrape ice particles from the cylindrical freezing chamber 22. The drive means assembly 18 rotatably drives the auger 26 such that when make-up water is introduced into the freezing chamber 22 through a suitable water inlet means 34 and frozen therein, the rotating auger 26 forcibly urges quantities of ice particles 37 through the freezing chamber 22 to be discharged through an ice outlet end 36 of the combination evaporator and ice-forming assembly 12.

The ice particles 37 are formed on the inner surface of the inner housing 20 in the usual manner by way of heat transfer between the freezing chamber 22 and an adjacent evaporator device 38, through which the above-mentioned refrigerant material flows from the refrigerant inlet 40 to the refrigerant outlet 42. The refrigerant inlet and outlet 40 and 42, respectively, are connected to respective refrigerant supply and return lines of the above-mentioned conventional refrigeration system. The details of the exemplary auger 26, according to the present invention, will be more fully described below.

In FIG. 1, a head assembly 50 is shown connected to the outlet end 36 of the combination evaporator and ice-forming assembly 12 and is adapted for forming a relatively dry and loosely associated flake-type or chip-type ice product 52. The head assembly 50 can be removably connectable to the combination evaporator and ice-forming assembly 12, as by threaded fasteners, for example, extending through a divider plate 46, which defines and is preferably part of the ice outlet end 36 of the combination evaporator and ice-forming assembly 12 and thus remains thereon. The head assembly 50 can be interchangeable with at least one other head assembly (not shown), which can also be similarly removably connectable through the preferred divider plate 46 to the combination evaporator and ice-forming assembly 12.

The head assembly 50 generally includes an annular collar member 54, removably connectable to the divider plate 46 preferably by way of threaded fasteners extending therethrough, and an inlet opening 56 in communication with one or more evaporator discharge openings 44 extending through the divider plate 46. The annular collar member 54 also includes an outer annular sleeve portion 58, which generally surrounds the inlet opening 56 and is preferably defined by a plurality of resilient and yieldable finger members 60 secured to, or integrally formed with, the remainder of the annular collar member 54.

An inner member 62 preferably includes a generally sloped or arcuate portion 63 extending at least partially into the interior of the outer annular sleeve portion 58 in a direction toward the inlet opening 56. The inner member 62 and the outer annular sleeve portion 58 of the collar member 54 are spaced from one another to define therebetween an annular compression passage 64, which terminates in an outlet annulus 66. Because of the sloped or arcuate configuration of the inner member portion 63, the annular cmpression passage 64 preferably has a decreasing annular cross-sectional area from the inlet opening 56 to the outlet annulus 66 in order to compress the wet and loosely associated ice particles 37 that are forcibly urged therethrough from the combination evaporator and ice-forming assembly 12. In addition to such decreasing annular cross-sectional area, the resilient finger members 60 establish a resilient resistance to outward movement of the wet and loosely associated ice particles 37 in order to further compress such particles 37 and remove at least a portion of the unfrozen water therefrom so as to form relatively dry and loosely associated flake or chip ice particles 52.

In addition to the above-discussed compressive forces exerted on the ice particles 37, the inner member 62 is also resiliently directed or forced toward the inlet opening 56 by a spring or other resilient biasing component (not shown), and a retainer member (not shown) is threadably attached to the upper end of the auger 26, which is described in more detail below.

It should be noted that the various components of the head assembly described herein (and other interchangeable head assemblies) can be molded from synthetic plastic materials in order to decrease their cost and weight. The plastic materials should, however, be capable of withstanding the forces, low temperatures, and other parameters encountered by such components in an ice-making apparatus, such parameters being readily determinable by those skilled in the art. One preferred example of such a plastic material is Delrin brand acetal thermoplastic resin, which is available in a variety of colors for purposes of color-coding various components in order to facilitate ease of proper assembly and identification of parts. "Delrin" is a trademark of E. I. Du Pont de Nemours & Co. Other suitable materials, such as appropriate metals for example, can also alternatively be employed.

Referring now more specifically to FIGS. 2 through 7, the exemplary auger 26 of the present invention includes a central body portion 28 having stepped portions 70 and 71 at its respective axial or longitudinal ends adapted to be rotatably received within auger bearings and/or ice-making head assemblies, as discussed above. At least one, and preferably more than one, spirally-oriented flight portion 30 is disposed on the radially outer surface of the central body portion 28, extending in a generally spiral flight path along all, or at least a substantial portion, of the axial length of the periphery of the central body portion.

The spiral flight portion or portions 30 have radially outer edges 72 adapted to contact the ice formed within the inner surface of the inner housing 20 mentioned above, for purposes of rotatably scraping ice particles from the cylindrical freezing chamber 22 shown in FIG. 1. In order to facilitate such scraping removal of ice particles, the outer edges 72 are preferably chamfered, as is perhaps best illustrated in FIGS. 5 through 7. In the most preferred configuration, the upper or forward leading portion of the outer edges 72 is chamfered at a greater angle relative to the longitudinal axis of the auger 26 than is the lower or trailing portion of the outer edges 72. Such preferred differential chamfering is indicated by reference numerals 73 and 74 for the leading end trailing portions, respectively, as shown in FIG. 5. Typically, a preferred angle for the chamfering of the leading portion 73 is approximately 45 degrees relative to a line parallel to the axis of rotation of the auger 26, while the trailing portion 74 is typically at an angle of approximately 15 degrees to approximately 20 degrees relative to such a parallel line. One skilled in the art will readily recognize, however, that these angular relationships can vary from those set forth herein as preferred relationships.

Figure 7:
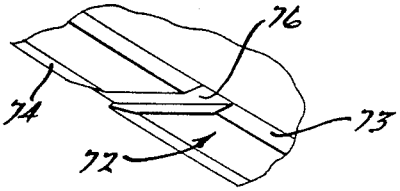
FIG. 7 is another partial, detail view of a portion of an ice-scraping flight of the auger member of FIG. 2, looking generally in the direction of the arrow 7 in FIG. 2.
Figure 3:
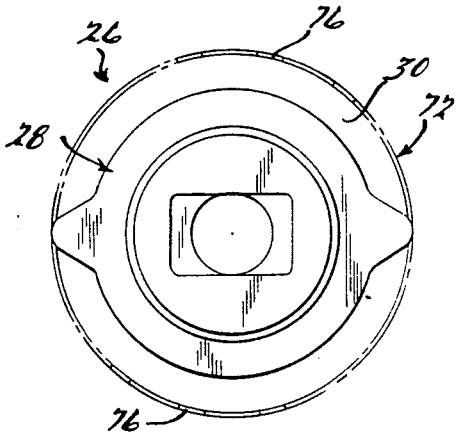

In order to reduce the loading being applied to the auger support bearings (not shown), the generally spirally-extending locus of contact of the outer scraping edge or edges 72 of the flight portion or portions 30 with the inner surface of the inner evaporator housing is preferably periodically and repeatedly interrupted by way of a number of spirally-spaced apart grooves or recesses 76 formed in the outer edges 72. Such groves 76 are preferably of a radial depth such that they extend through all, or at least a substantial portion, of the chamfered outer region of the outer edges 72, and have a radial depth no deeper than the radial depth of the chamfered outer portions of the outer edges 72, as illustrated in FIGS. 6 and 7. Although such grooves 76 can be arranged and oriented in any of a number of configurations and spacings, as will now occur to one skilled in the art, it is preferred that they are circumferentially oriented along an imaginary spirally-extending path, indicated generally by reference numeral 77 in FIG. 2, that would form a left-handed pitch configuration for an auger having its flight portions 30 also arranged in a left-handed spiral configuration, assuming the counterclockwise rotation of the auger 26, as indicated by the rotation arrow 78 in FIG. 2. In actual prototype versions of the auger 26, wherein the central body portion 28 had an axial length of approximately seven to nine inches, with a flight diameter of approximately three inches, an advantageous pitch configuration for the generally spiral locus formed by the grooves 76 was a 0.20 pitch, left-hand spiral, resulting in an arrangement of approximately 5 grooves per inch of axial auger central body length. In such actual prototypes, with the flight portions 30 extending radially outwardly approximately ½ inch to approximately 7/8 inch, the grooves were found to advantageously be formed with a radially inward depth of approximately 0.015 inch to approximately 0.020 inch. As one skilled in the art will readily appreciate, however, these physical dimensions can vary depending upon the design parameters of the ice-making apparatus, and the relative sizes of the various portions of the auger or auger-assembly.

The provision of the grooves 76 in the outer edges 72 of the flight portions 30 accomplishes a significant reduction in auger bearing load by reducing the area of contact between the outer flight portion edges 72 and the ice being removed from the inner surface of the evaporator assembly. Such reduction of this area of contact tends to concentrate the ice-scraping forces required to remove the ice over a smaller area on the flight portions, thereby raising the localized stresses on the ice being removed, and consequently causing smaller pieces of ice to be removed at any one location along the auger flight portion. In addition, the flight portion contact interruption provided by the grooves 76 also tends to distribute the removed ice pieces over a larger portion of the freezing chamber 22, shown in FIG. 1, which results in a more even balance of the forces on the auger bearings. Finally, such contact interruption provided by the groove 76 also has the effect of breaking up the mass of ice pieces removed from the inner surface of the evaporator assembly due to the discontinuous nature of the contact locus between the outer edges 72 of the flight portions 30 and such inner surface.

Although it is currently preferred that the auger 26 be constructed as a solid, one-piece member, preferably having a metallic composition such as stainless steel, for example, possible alternate constructions include a one-piece synthetic composition, or a multi-piece arrangement, such as a synthetic central body with metallic flight portions integrally molded therein, or even the segmented, multiple disc construction disclosed in the above-mentioned previous patent, U.S. Pat. No. 4,682,475, for example, wherein the auger 26 includes a number of separate disc portions axially stacked on a central core, as is generally illustrated in phantom lines, with accompanying reference numeral 126, in FIG. 1. The exact construction and composition of the auger 26 depends upon various design considerations and parameters, as well as various performance specifications and objectives, as will be fully appreciated by one skilled in the art.

Additional objects, advantages and features of the present invention will become apparent from the following description and appended claims, taken in conjunction with the accompanying drawings.

What is claimed is:

1. In an ice-making apparatus having a housing defining a substantially cylindrical freezing chamber, refrigeration means adjacent the freezing chamber, means for supplying ice make-up water to the freezing chamber, and an axially-extending auger rotatably mounted in the freezing chamber, the auger including a central body portion and at least one flight portion extending in a generally spiral flight path along at least a substantial part of the axial length of the periphery of said central body portion with the outer edge of said flight portion being adapted to be disposed closely adjacent the inner surface of the housing in order to scrape ice particles therefrom as said auger is rotated, the improvement wherein said flight portion includes at least one groove formed therein transversely across said outer edge, said groove interrupting the generally spiral locus of scraping contact between said outer edge of said flight portion and the ice formed on said inner surface of the housing in order to reduce the area of scraping contact between said outer edge and said inner surface and to provide a stress-relieved area on said flight portion during the scraping of the ice parting from said inner surface of the housing when said auger is rotated, said flight portion having a chamfered outer edge portion, said groove extending through at least a portion of said chamfered outer edge portion and said groove being spaced radially outward from said central body and having a radial depth no deeper than the radial depth of said chamfered outer edge portion.

2. The invention according to claim 1, wherein said groove is oriented along a generally spiral path extending about said central body portion, said generally spiral path of said groove extending transversely across said outer edges of said flight portion.

3. The invention according to claim 1, wherein said flight portion includes a number of said grooves formed therein, said grooves being spaced apart along said generally spiral flight path.

4. The invention according to claim 3, wherein said grooves are oriented along generally spiral paths extending about said central body portion, said generally spiral paths of said grooves extending transversely across said outer edges of said flight portion.

5. The invention according to claim 1, wherein said auger includes a number of said flight portions, each extending along a generally spiral flight path, each of said flight portions having a number of said grooves formed therein, said grooves being spaced apart along said generally spiral flight paths.

6. The invention according to claim 5, wherein said grooves are oriented along a generally spiral path extending about said central body portion, said generally spiral paths of said grooves extending transversely across said outer edges of said flight portions.

7. The invention according to claim 1, wherein said central body portion and said flight portion are integrally formed as a one-piece structure.

8. The invention according to claim 1, wherein said auger comprises a plurality of discrete disc elements axially stacked on a rotatable shaft member and secured for rotation therewith, the axial length of each of said disc elements being substantially less than the axial length of said auger.

* * * * *

UNITED STATES PATENT AND TRADEMARK OFFICE

CERTIFICATE OF CORRECTION

PATENT NO. : 4,932,223

DATED : June 12, 1990

INVENTOR(S) : Roger W. Paul; David A. Tandeski

It is certified that error appears in the above-identified patent and that said Letters Patent is hereby corrected as shown below:

Col. 2, Line 59, "rceiving" should be --receiving--;

Col. 4, Line 10, "cmpression" should be --compression--;

Col. 5, Line 22, "groves" should be --grooves--;

Col. 6, Line 29-32, "Additional objects, advantages and features of the present invention will become apparent from the following description and appended claims, taken in conjunction with the accompanying drawings" should be --The foregoing discussion discloses and describes merely exemplary embodiments of the present invention for purposes of illustration only. One skilled in the art will readily recognize from such discussion, and from the accompanying drawings and claims, that various changes and modifications, and variations therein can be made without departing from the spirit and scope of the invention as defined in the following claims.--

Signed and Sealed this

Fourteenth Day of January, 1992

*Attest:*

HARRY F. MANBECK, JR.

*Attesting Officer*

*Commissioner of Patents and Trademarks*